US009010050B2

(12) United States Patent
Hatzinikolas

(10) Patent No.: US 9,010,050 B2
(45) Date of Patent: Apr. 21, 2015

(54) PRE-CAST RAIN SCREEN WALL PANEL

(76) Inventor: Michael Hatzinikolas, Edmonton (CA)

( * ) Notice: Subject to any disclaimer, the term of this patent is extended or adjusted under 35 U.S.C. 154(b) by 814 days.

(21) Appl. No.: 12/764,629

(22) Filed: Apr. 21, 2010

(65) Prior Publication Data

US 2010/0287865 A1 Nov. 18, 2010

Related U.S. Application Data

(63) Continuation-in-part of application No. 12/684,388, filed on Jan. 8, 2010, now abandoned.

(51) Int. Cl.

| | |
|---|---|
| ***E04F 17/00*** | (2006.01) |
| ***E04C 2/04*** | (2006.01) |
| ***B28B 19/00*** | (2006.01) |
| ***B28B 23/02*** | (2006.01) |
| ***E04B 1/70*** | (2006.01) |

(52) U.S. Cl.

CPC ..... *E04C 2/044* (2013.01); *B28B 19/0015* (2013.01); *B28B 23/028* (2013.01); *E04B 1/70* (2013.01); *E04C 2002/046* (2013.01)

(58) Field of Classification Search

USPC ..... 52/302.1, 302.3, 405.1, 405.3, 408, 52/410, 411, 426, 742.13, 742.14

See application file for complete search history.

(56) References Cited

U.S. PATENT DOCUMENTS

| | | | | |
|---|---|---|---|---|
| 601,753 | A | 4/1898 | Kaiser | |
| 2,609,956 | A | 9/1952 | Stevenson | |
| 2,645,929 | A * | 7/1953 | Jones | 52/405.3 |
| 2,718,138 | A | 9/1955 | Jones | |
| 3,498,015 | A | 3/1970 | Green et al. | |
| 3,828,502 | A | 8/1974 | Carlsson | |
| 4,057,298 | A * | 11/1977 | Seegers | 303/84.1 |
| 4,117,639 | A * | 10/1978 | Steenson et al. | 52/223.6 |
| 4,295,415 | A | 10/1981 | Schneider, Jr. | |
| 4,712,349 | A * | 12/1987 | Riley et al. | 52/408 |
| 4,841,702 | A | 6/1989 | Huettemann | |
| 5,369,926 | A * | 12/1994 | Borland | 52/302.1 |
| 5,582,388 | A | 12/1996 | Baxter | |
| 5,596,853 | A | 1/1997 | Blaney et al. | |
| 5,704,180 | A | 1/1998 | Boeck | |
| 5,927,032 | A | 7/1999 | Record | |
| 6,018,918 | A | 2/2000 | Long, Sr. | |
| 6,298,620 | B1 | 10/2001 | Hatzinikolas | |
| 6,351,918 | B1 | 3/2002 | Westra et al. | |
| 6,761,007 | B2 | 7/2004 | Lancelot, III et al. | |
| 6,990,775 | B2 | 1/2006 | Koester | |
| 7,367,165 | B2 | 5/2008 | Hatzinikolas | |
| 2006/0179748 | A1 * | 8/2006 | Schmidt | 52/302.1 |

FOREIGN PATENT DOCUMENTS

| | | |
|---|---|---|
| CA | 2490286 A1 | 7/2005 |
| EP | 1044311 B1 | 7/2003 |
| EP | 1185748 B1 | 3/2009 |
| GB | 2000537 B | 1/1982 |

* cited by examiner

*Primary Examiner* — William Gilbert

(74) *Attorney, Agent, or Firm* — Bereskin & Parr LLP/S.E.N.C.R.L., s.r.l.; Kenneth L. Bousfield

(57) ABSTRACT

A prefabricated rain screen wall panel is provided comprising inner and outer concrete panels secured together by shear connectors. Intermediate members provide insulation, a drainage channel and a vapor barrier.

33 Claims, 6 Drawing Sheets

PRE-CAST RAIN SCREEN WALL PANEL

CROSS REFERENCE TO RELATED APPLICATIONS

This application is a continuation-in-part of U.S. Utility patent application Ser. No. 12/684,388 filed on Jan. 8, 2010, which is still pending, the entire content of which are hereby incorporated by reference.

FIELD

The invention relates to the control of moisture within walls using a pre-cast construction. In a particularly preferred embodiment, the invention relates to a modular pre-fabricated wall panel, which may be used in the construction of a building wherein the building has an outer facing of stucco, brick, wood or aluminum siding or the like.

INTRODUCTION

Structural walls for buildings, such as residential, commercial or industrial buildings, are often constructed in layers. Typically, a wall sits on a foundation and includes a back-up wall having a floor plate and a ceiling plate and a set of vertical studs. Usually sheathing, which may be plywood, oriented strand board or the like, is disposed on the outside face of the back-up wall (i.e., the side that faces towards the outside of the building). The sheathing is covered by a moisture barrier membrane. Insulation is typically installed on the outside face of the moisture barrier membrane. An outer facing, such as stucco, brick or a siding material is then typically provided as the outer component of the wall.

Pre-fabricated wall sections are known. For example, Carlson (U.S. Pat. No. 3,828,502) discloses a pre-fabricated panel wherein insulation is surrounded by a thin skin, which may be aluminum. Huettemann (U.S. Pat. No. 4,841,702) discloses a three-layer insulated concrete panel. The middle layer comprises an insulating slab having grooves, which provide a form for casting of concrete supporting ribs integral with a layer of concrete cast over the grooved face. Rebar may also be positioned in the grooves.

SUMMARY

In accordance with this invention, a pre-fabricated rain screen wall panel is provided. The pre-fabricated wall panel comprises a multi-layer panel, which includes channels to permit water to flow internally in the wall panel downwardly and be evacuated from the pre-fabricated construct by any means known in the art. Accordingly, the pre-cast wall panels may be installed on any standard foundation and installed such that any water that accumulates at the bottom of the wall panel may drain to the outside of the building.

An advantage of the design is that it permits wall panels to be constructed, such as in a factory and then conveyed to a building site where the panels may be assembled together on a foundation to produce a wall of a building. It will be appreciated that wall panels may be constructed in a variety of sizes so as to accommodate any particular profile of the outer perimeter of a building.

The pre-fabricated construction permits the wall panels to be assembled under more appropriate conditions than occur at a building site. For example, the concrete may cure under more ideal conditions thereby increasing the strength of the concrete. In addition, as opposed to pouring concrete into a vertical mould, the concrete may be pre-fabricated in horizontal layers thereby assisting in ensuring the absence of voids or the reduction of voids in the concrete, which may impair the strength of the concrete.

In accordance with a first aspect of this invention, there is provided a prefabricated assembly comprising:

(a) inner and outer concrete panels;

(b) an intermediate drainage panel positioned adjacent the outer concrete panel and having an inner face and an outer face and a plurality of drainage channels provided on a face thereof, the outer face is adjacent an inner face of the outer panel;

(c) an intermediate insulation panel positioned adjacent the intermediate drainage panel;

(d) a vapour barrier positioned between the intermediate insulation panel and the inner concrete panel; and, (e) a plurality of shear connectors, each having a first portion, a second portion and an intermediate portion extending between the first and second portions, the first portion provided in the inner concrete panel and the second portion provided in the second concrete panel.

In some embodiments, the drainage channels are provided on the inner face of the intermediate drainage panel.

In some embodiments, the inner face of the intermediate drainage panel is adjacent an outer face of the intermediate insulation panel.

In some embodiments, the vapour barrier is positioned between an inner face of the intermediate insulation panel and an outer face of the inner concrete panel.

In some embodiments, the first and second portions are configured to be secured in the concrete panels.

In some embodiments, the intermediate portion extends at an angle to each of the first and second portions.

In some embodiments, the intermediate drainage panel comprises insulation material.

In some embodiments, the prefabricated assembly further comprises rebar provided in each of the inner and outer concrete panels and the first portions are secured to rebar in the inner concrete panel and the second portions are secured to rebar in the outer concrete panel.

In some embodiments, the intermediate drainage panel has an absence of internal channels.

In accordance with another aspect of this invention, there is also provided a prefabricated assembly comprising:

(a) inner and outer concrete panels;

(b) first and second intermediate panels positioned between the inner and outer concrete panels, one of the first and second intermediate panels having a plurality of drainage channels provided on a face thereof, each of the intermediate panels having an inner face and an outer face;

(c) a vapour barrier positioned between the inner and outer concrete panels; and, (d) a plurality of shear connectors, each having a first portion, a second portion and an intermediate portion extending between the first and second portions, the first portion provided in the inner concrete panel and the second portion provided in the second concrete panel.

In some embodiments, the drainage channels are provided on the inner face of the first intermediate panel.

In some embodiments, the inner face of the first intermediate panel is adjacent an outer face of the second intermediate panel.

In some embodiments, the vapour barrier is positioned between an inner face of the second intermediate panel and an outer face of the inner concrete panel.

In some embodiments, the first and second portions are configured to be secured in the concrete panels.

In some embodiments, the intermediate portion extends at an angle to each of the first and second portions.

In some embodiments, the prefabricated assembly further comprises rebar provided in each of the inner and outer concrete panels and the first portions are secured to rebar in the inner concrete panel and the second portions are secured to rebar in the outer concrete panel.

In some embodiments, the intermediate drainage panel has an absence of internal channels.

In accordance with another aspect of this invention, there is also provided a method of preparing a prefabricated panel comprising:

(a) providing a first concrete panel having first portions of shear connectors provided therein, the shear connectors having intermediate portions extending outwardly from the concrete panel;

(b) providing a vapour barrier in overlying relation to the first concrete panel, the intermediate portions extending through the vapour barrier;

(c) providing an insulation panel in overlying relation to the vapour barrier, the intermediate portions extending through the insulation panel;

(d) providing a drainage panel in overlying relation to the insulation panel, the intermediate portions extending through extending through the drainage panel; and, (e) providing a second concrete panel in overlying relation to the drainage panel, the intermediate portions extending to the outer panel, wherein second portions of shear connectors are provided in the second concrete panel.

wherein steps (a)-(e) and conducted sequentially in the order of step (a) to step (e) or step (e) to step (a).

In some embodiments, step (a) further comprises providing rebar in the first concrete panel and step (e) further comprises providing rebar in the second concrete panel.

In some embodiments, step (a) further comprises securing the first portions to the rebar in the first concrete panel and step (e) further comprises securing the second portions to the rebar in the rebar in the second concrete panel.

In some embodiments, the method further comprises shipping the prefabricated panel to a construction site.

It has surprisingly been determined that a pre-fabricated panel utilizing sheer connectors to secure together the elements of a panel wherein the panel has internal voids permits a wall panel to be pre-fabricated at one location and then transported and installed without damaging the vapour barrier or the rain channel system incorporated into the prefabricated panel.

DRAWINGS

These and other advantages of the instant invention will be more fully and completely understood in conjunction with the following description of a preferred embodiment of the invention in which.

DESCRIPTION OF VARIOUS EMBODIMENTS

Figure 1:
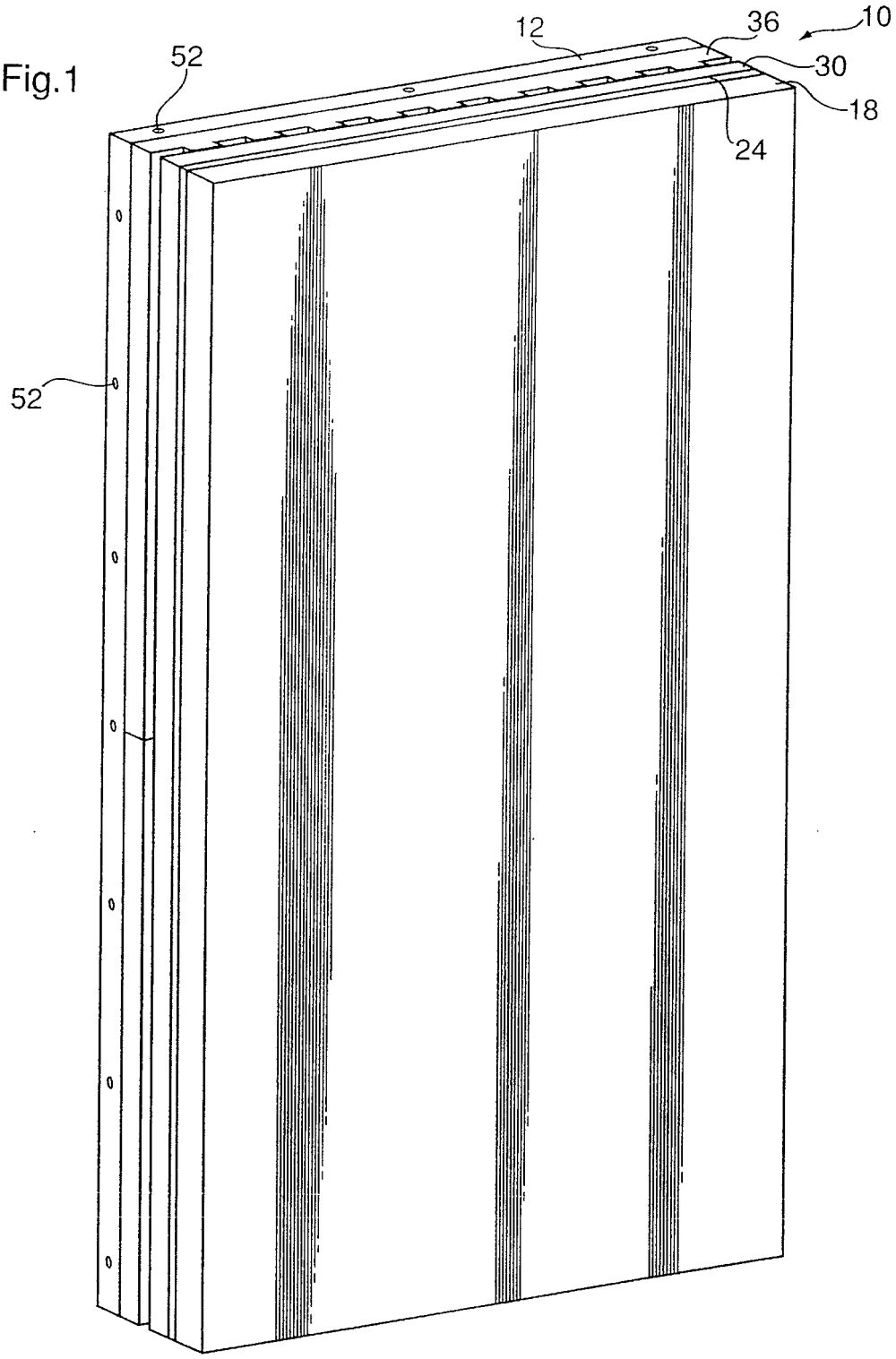
FIG. 1 is a perspective view of a modular pre-fabricated panel in accordance with an embodiment of this invention.

As exemplified in FIG. 1, in accordance with a preferred embodiment of this invention, pre-cast rain screen wall panel 10 comprises a first or outer concrete panel 12 and a second or inner concrete panel 18 wherein a vapour barrier 24, an intermediate insulation panel 30 and an intermediate drainage panel 36 are provided between the inner and outer concrete panels 12, 18. A plurality of shear connectors 44 extend between the inner and outer concrete panels 12, 18 and secure the pre-cast rain screen wall panel together as an integral unit.

Figure 2:
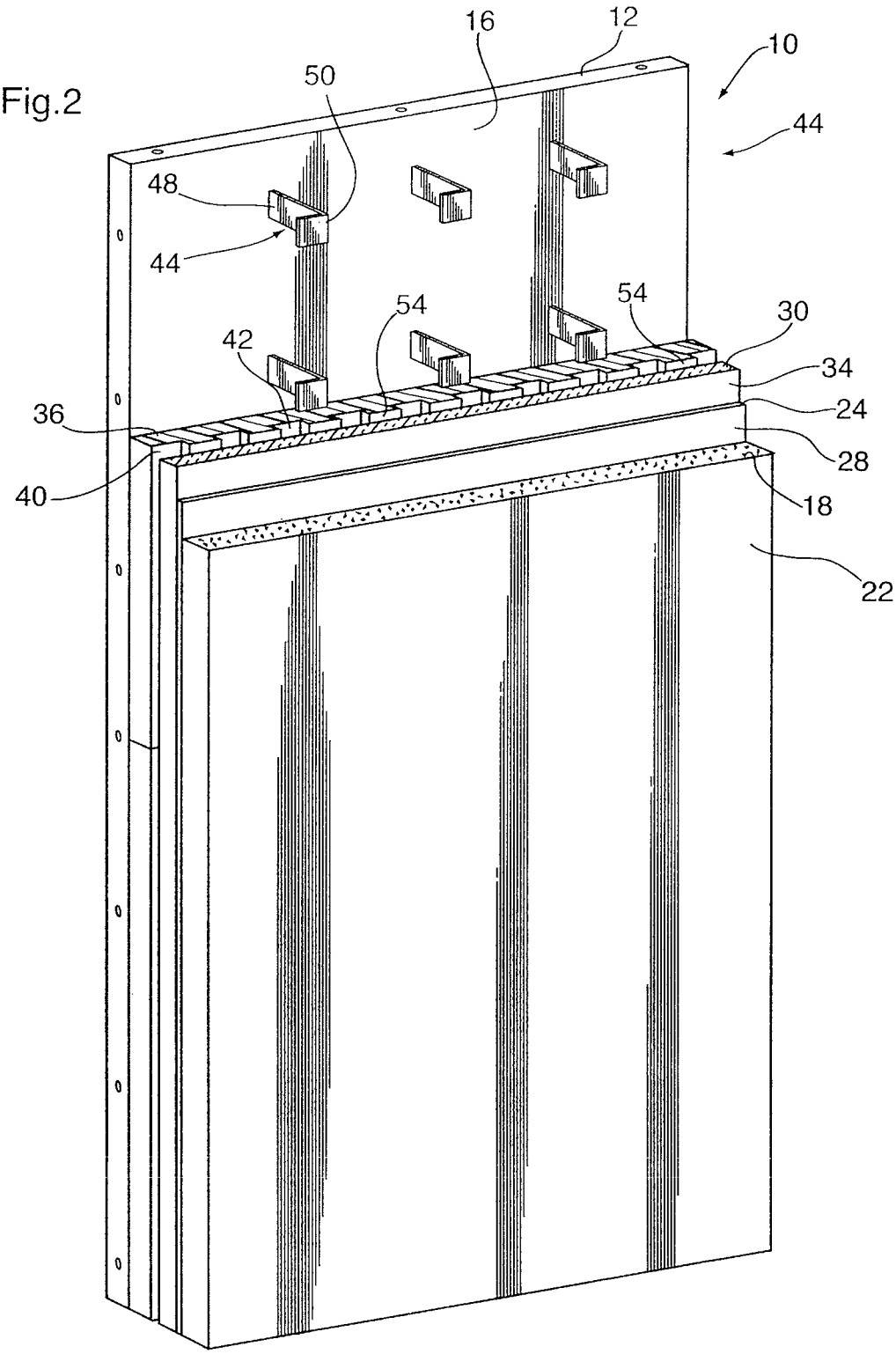
FIG. 2 is a partially broken away perspective view of the modular panel of FIG. 1.
Figures 5, 6, 7:
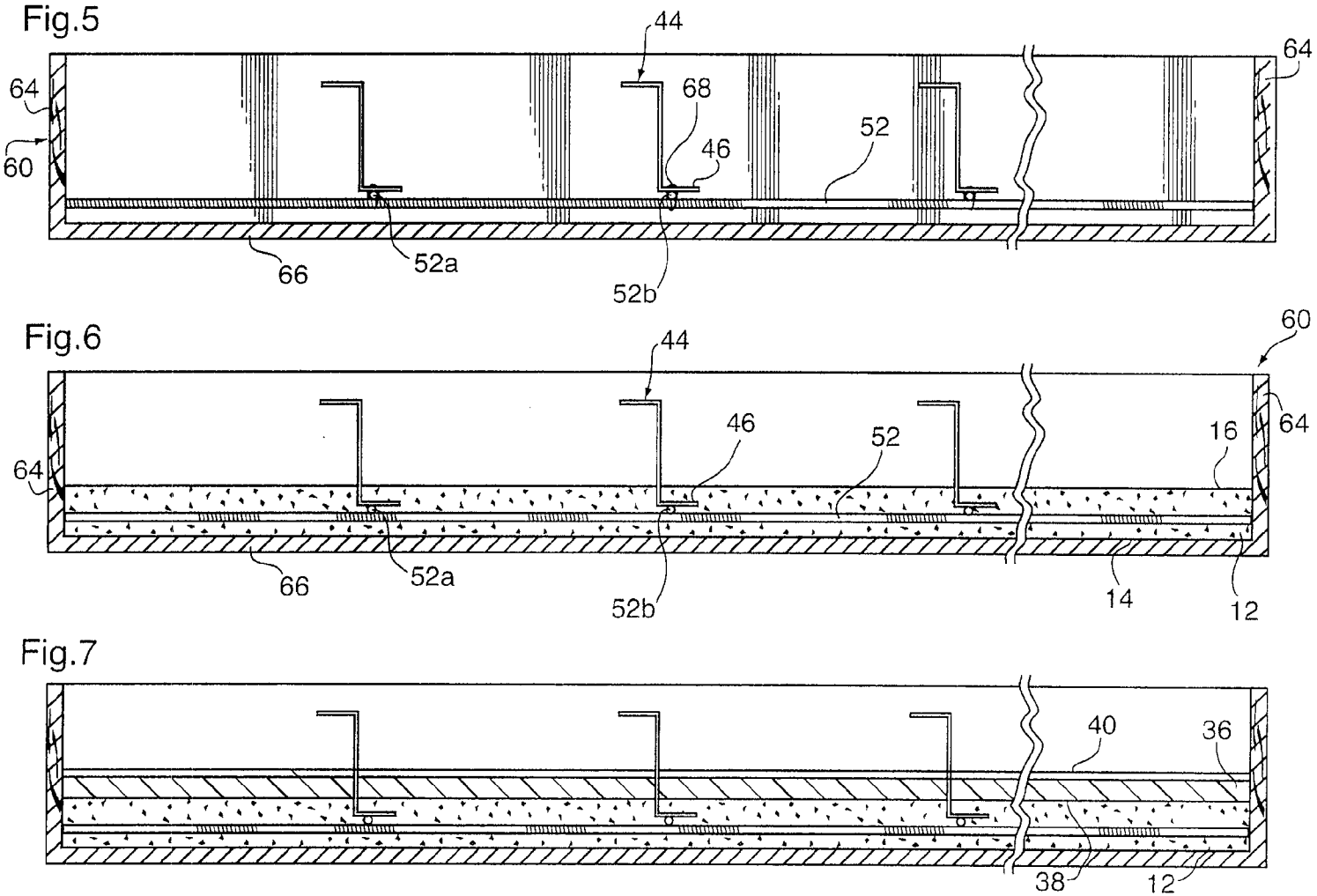
FIG. 5 is a cross-section along the line 5-5 shown in FIG. 4.
FIG. 6 is a cross-section along the line 5-5 shown in FIG. 4 wherein concrete has been placed in the bottom of the form.
FIG. 7 is a cross-sectional along the line 5-5 in FIG. 4 wherein a plurality of intermediate drainage panels have been positioned on top of the concrete with the drainage channels on the upper surface.

Outer concrete panel 12 has an outer surface 14 and an inner surface 16 (see FIGS. 2 and 6). Outer surface 14 comprises the outer surface of the rain screen wall panel 10 and accordingly faces outwardly from the building. Accordingly, a facing or other construct, if desired, may be provided on outer surface 14, or spaced from and facing outer surface 14. It will be appreciated that, in an alternate embodiment, the facing may be integrally formed with panel 10.

Outer concrete panel 12 preferably has a thickness in the direction extending between outer and inner surfaces 14, 16 of between 2-6 inches and preferably 3-4 inches and more preferably about 3 inches. Outer concrete panel 12 may be constructed from any concrete typically used in building construction. It will be appreciated that outer concrete panel may be of any dimensions and may be customized for any building. For example, outer concrete panel 12 may have a length of 20 feet or more and a width of 20 feet or more. Alternately, outer concrete panel 12 may have a length of eight feet and a width of four feet. It will be appreciated that, if larger dimensions are utilized, that the thickness of outer concrete panel 12 is preferably increased.

Positioned inwardly from outer concrete panel 12 is intermediate drainage panel 36. Intermediate drainage panel 36 has outer surface 38 and inner surface 40 (see FIGS. 2 and 7). Outer surface 38 is preferably positioned immediately adjacent and touching inner surface 16 of outer concrete panel 12. Inner surface 40 of drainage panel 36 is provided with at least one and preferably a plurality of drainage channels 42 (see FIGS. 2 and 3). The drainage channels 42 are configured such that water positioned between intermediate drainage panel 36 and intermediate insulation panel 30 may drain to the bottom of panel 10. Accordingly, drainage channels 42 preferably run from the top of panel 10 to the bottom of panel 10, preferably in a straight line. Accordingly, as exemplified in FIGS. 2 and 3, drainage channels preferably extend vertically when panel 10 is installed in a building.

Intermediate drainage panel 36 preferably has the same dimensions as outer panel 12. However, intermediate drainage panel 36 may be smaller than outer panel 12 and a plurality may be utilized in the construction of a single panel 10.

Intermediate drainage panel 36 may be constructed from a variety of materials and, preferably, is constructed from an insulating material. Preferably, intermediate insulation panel 36 is a rigid member. Accordingly, panel 36 may be constructed from an insulating foam such as rigid, extruded polystyrene. However, other insulating materials may be used or other rigid materials capable of having drainage channels therein may be used. Intermediate drainage panel 36 may provide insulation value and may contribute to the overall R-value of the panel 10. Accordingly, the material that is used and/or the thickness of intermediate drainage panel 36 may be selected to achieve a particular R-value for intermediate drainage panel 36. For example, intermediate drainage panel 36 may be from 1 to 4 inches thick and preferably is about 1-1.5 inches thick and more preferably is about 1 inch thick.

Drainage channels 42 may be integrally constructed with panel 36 (e.g., molded into a surface of panel 36). Alternately, drainage channels may be cut into panel 36 after it is formed. In a further alternate embodiment, drainage channels 42 may be an additional layer that is secured to panel 36 after it is formed. In a particular preferred embodiment, drainage panel 36 may be a Korax™ panel.

Figure 3:
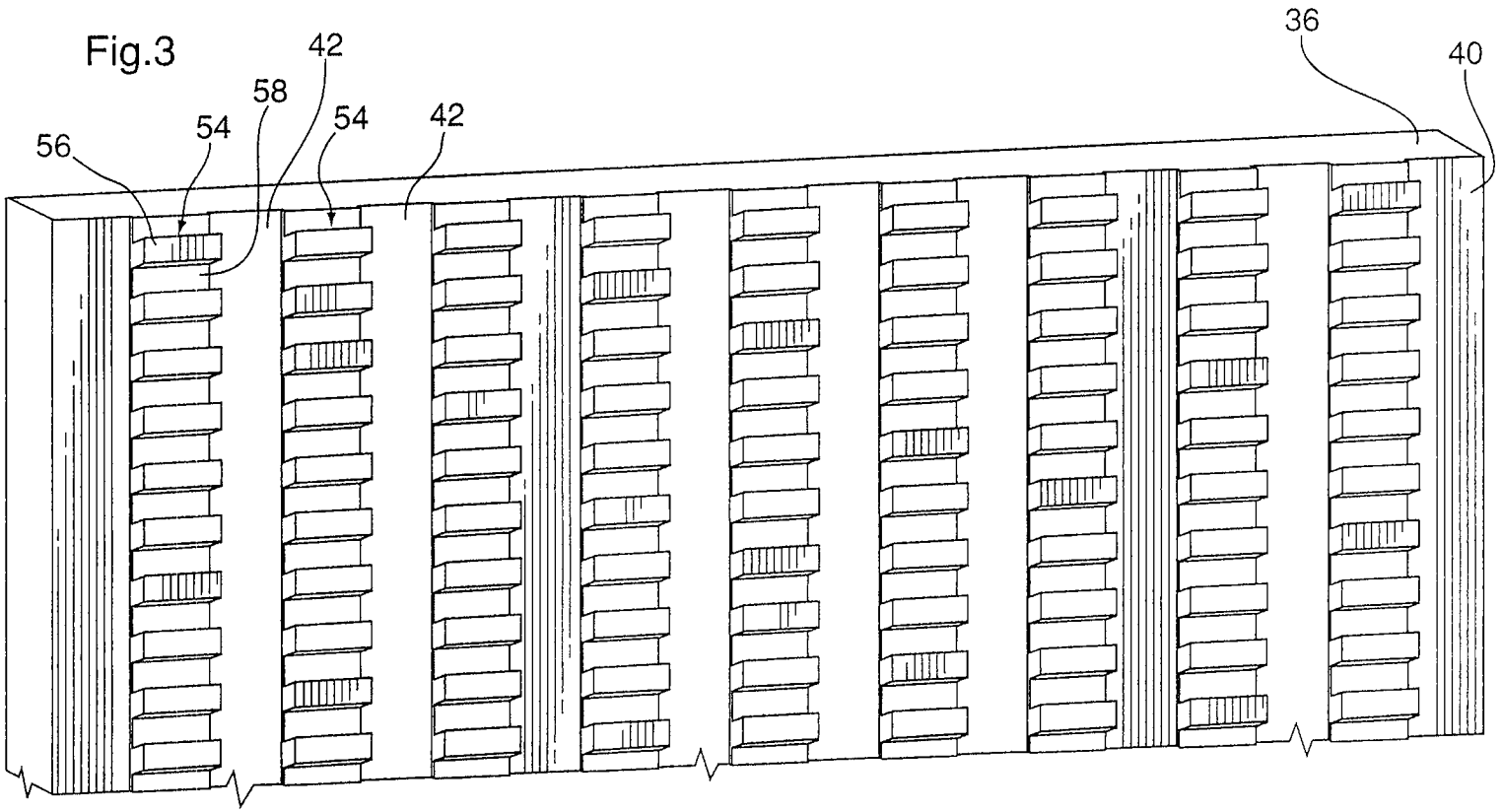
FIG. 3 is a perspective view of the inner surface of the intermediate drainage panel shown in FIG. 2.

As exemplified in FIG. 3, drainage channels 42 are spaced apart and recessed inwardly with respect to projecting columns 54. Accordingly, each drainage channel 42 may comprise a generally U-shaped channel, which is recessed inwardly from the outer surface 56 of projecting columns 54. Outer surface 56 of projecting columns 54 may be a continuous outer surface. Alternately, a plurality of grooves 58 extending transverse to projecting column 54 may be provided. Accordingly, grooves 58 may provide air or water flow channels from one drainage channel 42 to the next spaced apart drainage channel 42.

Positioned inwardly from intermediate insulation panel 36 is intermediate drainage panel 30. Intermediate insulation panel 30 has an outer surface 32 and an inner surface 34 (see FIGS. 2 and 8). Outer surface 32 is positioned facing inner surface 40 of intermediate drainage panel 36 and, preferably, is positioned adjacent inner surface 40. For example, outer surface 32 may abut outer surface 56 of projecting columns 54.

Similar to intermediate drainage panel 36, intermediate insulation panel 30 may be the same dimension as outer panel 12. Alternately, intermediate insulation panel 30 may be smaller and a plurality may be used to construct a single panel 10.

Intermediate insulation panel 30 may be constructed from any insulating material. Preferably, intermediate insulation panel 30 is a rigid member. Accordingly, panel 30 may be constructed from an insulating foam such as rigid, extruded polystyrene. However, other insulating materials may be used. The material that is used and/or the thickness of intermediate insulation panel 30 may be selected to achieve a particular R-value for intermediate insulation panel 30. For example, intermediate insulation panel 30 may be from 1 to 5 inches thick and is preferably about 2 inches thick.

It will be appreciated that, combined, intermediate drainage panel 36 and intermediate insulation panel 30 may provide the requisite insulation for panel 10. Accordingly, the thickness and/or the material used to construct either may be varied provided that the requisite overall R-value for panel 10, if needed, is obtained. Additional intermediate layers may be provided and their sequence varied. Further, if intermediate drainage panel 36 provides sufficient insulation value, then intermediate panel 30 need not provide any insulation value and may be made of any material. In such a case, intermediate panel 30 provides a surface to ensure that the drainage channels remain open once the panel 10 is constructed.

Figure 9:
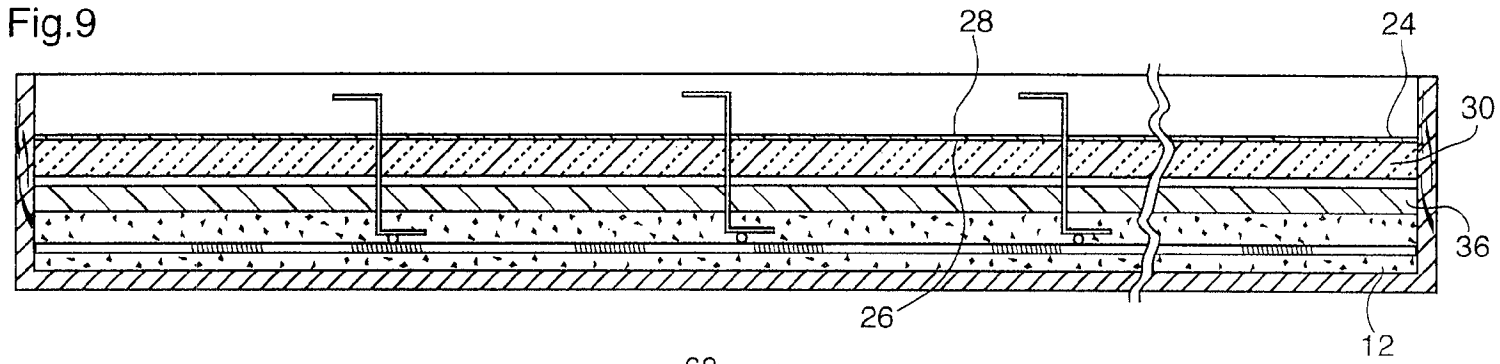
FIG. 9 is a cross-section along the line 5-5 in FIG. 4 wherein a vapour barrier has been placed on top of the insulation panel; and, FIG. 10 is cross-section along the line 5-5 in FIG. 4 wherein concrete has been poured on top of the vapour barrier.

Vapour barrier 24 is positioned inward of intermediate insulation panel 30 (see FIGS. 2 and 9). Vapour barrier 24 has an outer surface 26 and an inner surface 28. Vapour barrier 26 may be made from any moisture control membrane known or used in the building arts. It may be a thermally fused membrane, a peel and stick air vapour barrier or any other approved air vapour barrier. Preferably, vapour barrier 24 is the same size as panel 12. However, it will be appreciate that a plurality of pieces of vapour barrier 24 may be utilized and connected together so as to form a vapour barrier that has an extent so as to cover all of outer surface 20 of inner concrete panel 18. It will further be appreciated that a plurality of layers of vapour barrier 24 may be provided. Outer surface 26 of vapour barrier 24 preferably abuts inner surface 34 of intermediate insulation panel 30.

Figure 10:
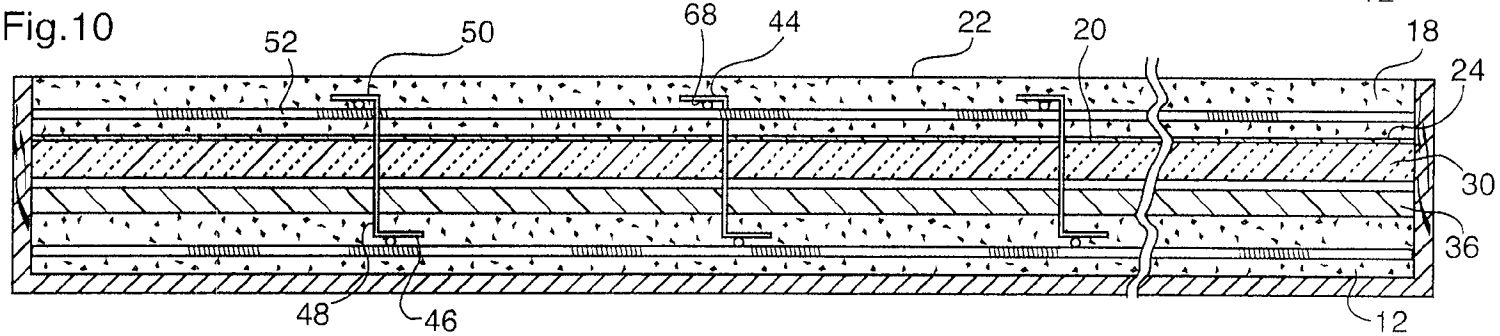

Inner concrete panel 18 is positioned inward of vapour barrier 24 (see FIGS. 2 and 10). Inner concrete panel 18 has an outer surface 20 and an inner surface 22. Outer surface 20 preferably abuts inner surface 28 of vapour barrier 24. Inner surface 22 may be the inner surface of panel 10 to which a decorative interior coating may be applied. Alternately, inner surface 22 may be painted or otherwise treated as is known in the art.

Inner panel 18 may be made from the same type of concrete as outer concrete panel 12. Alternately, a different type of concrete may be utilized. Inner concrete panel 18 may have the same thickness as outer concrete panel 12 or, alternately, it may have a different thickness. Preferably, in and outer concrete panels 12 and 18 have the same thickness.

Panel 10 is secured together by a plurality of shear connectors 44. Shear connectors may be of any configuration that extends between concrete panels 12, 18 and secure them together. As exemplified in FIG. 10, shear connector is provided with a first portion 46 in outer concrete panel 12, a second portion 50 in inner concrete panel 18 and an intermediate portion 48 extending between the first and second portions. In the exemplified embodiment, shear connector 44 is Z shaped. Accordingly, first and second portions 46, 50 extend at an angle, preferably a right angle, to intermediate portion 48. In this configuration, shear connectors 44 are secured in the concrete of panels 12, 18 so as to resist being pulled outwardly therefrom. It will be appreciated that alternate configurations of shear connectors 44 may be used. For example, shear connectors 44 may have first and second portions 46, 50 that extend parallel or generally parallel to intermediate portion 48 but which have at least one and preferably a plurality of openings therethrough. Accordingly, the concrete of panels 12, 18, when poured, may flow through the openings and thereby secure shear connectors 44 in panels 12, 18. Other designs may also be used.

Figure 4:
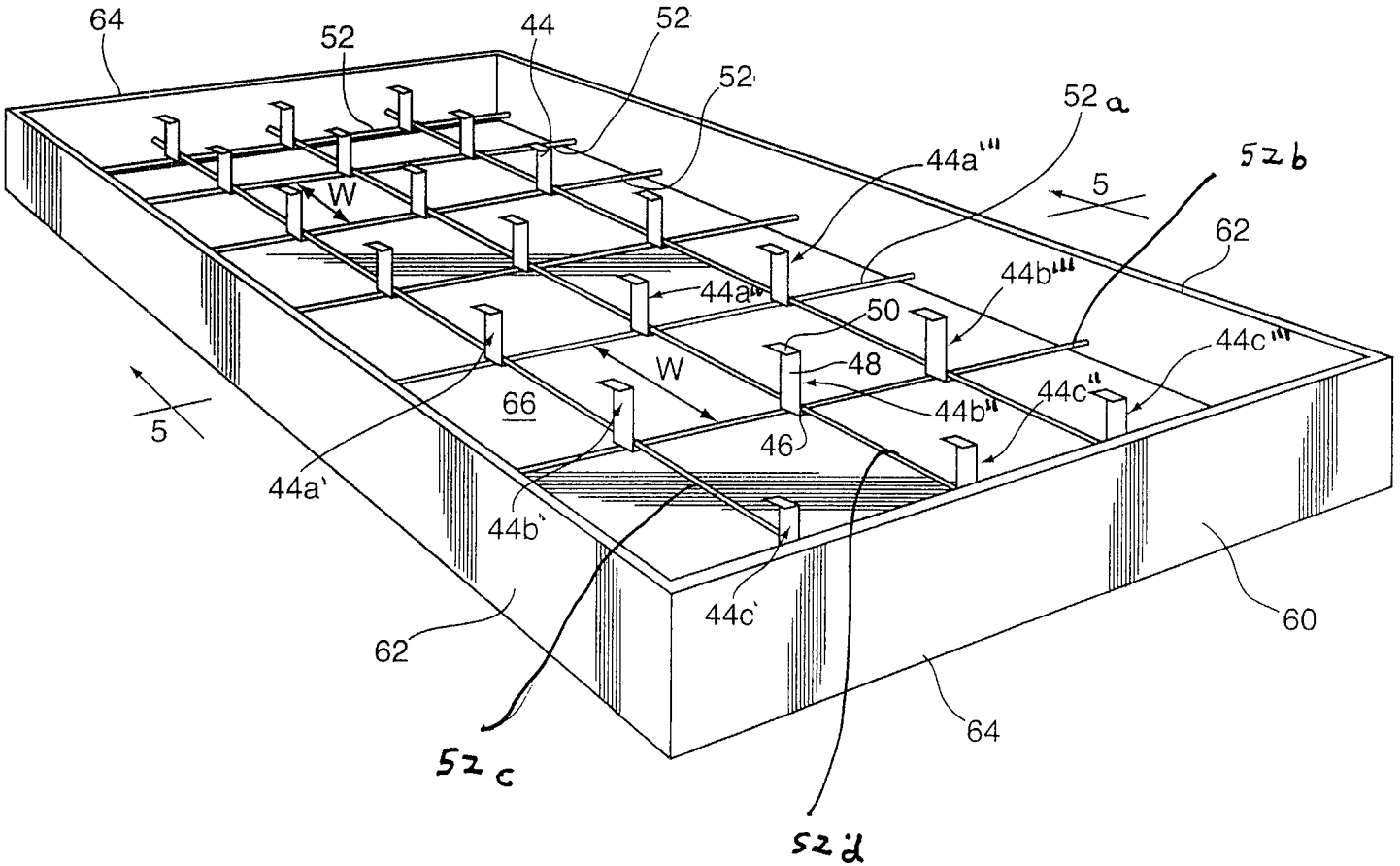
FIG. 4 is a perspective view of a form that may be utilized to prepare one or more modular panels of FIG. 1 wherein rebar and shear connectors have been placed in the bottom of the form.

Shear connectors 44 may also be in any particular orientation. As exemplified in FIGS. 2 and 5, shear connectors 44 have a first portion 46 and a second portion 50 that are embedded in the concrete layers 12, 18. As exemplified, these portions preferably extend in the same direction and preferably in a direction perpendicular to the longitudinal axis of the panel 10. Referring to FIG. 4, first portion 46 and second portion 50 extend away from intermediate portion 48 in a direction perpendicular to sides 62 of the form 60.

Shear connectors 44 may also be positioned at various locations in panel 10. As exemplified in FIGS. 2 and 5, shear connectors 44 are preferably evenly spaced apart in rows in panel 10. Referring to FIG. 4, rebar 52*a* has three shear connectors 44 positioned in a row, namely 44*a*′, 44*a*″ and 44*a*‴. Similarly, rebar 52*b* has three shear connectors 44 positioned in a row, namely 44*b*′, 44*b*″ and 44*b*‴. The middle shear connector 44*a*″ on rebar 52*a* is preferably positioned at the centre of panel 10. To either side of middle shear connector 44*a*″ are outer shear connectors 44*a*′ and 44*a*‴ that are positioned between the middle shear connector 44*a*″ and the sides of panel 10 (i.e., the sides of the panel at sides 62 of form 60). As there are 3 shear connectors 44 dividing rebar 52*a* into four sections, each of these outer shear connectors is preferably positioned inwards about ¼ of the distance of the width of the panel 10 (i.e. ¼ of the length of side 64 of form 60). Accordingly, the distance between the side of panel 10 adjacent side 62 of form 60 and the proximate outer shear connector 44*a*′ is preferably the same as the distance between that outer shear connector 44*a*′ and the middle shear connector 44*a*″. Similarly, the distance between the middle shear connector 44*a*″ and the other outer shear connector 44*a*″ is preferably the same as the distance between that outer shear connector 44*a*″ and other side of the panel 62. Alternately, or in addition, shear connectors 44 are preferably evenly spaced apart in columns in panel 10. Accordingly, for example, each row of shear connectors 44 may be spaced from an adjacent row of shear connectors 44 by a uniform amount. Referring to FIG. 4, one column of shear connectors includes shear connectors 44*a*′, 44*b*′ and 44*c*′. That row, as exemplified, comprises 7 shear connectors dividing the rebar into eight sections, each of which is preferably spaced apart the same distance W. Thus, the row of shear connectors 44*a* may be spaced apart from the row of shear connectors 44*b* by a distance W that is the same as the distance between the row of shear connectors 44*b* and the row of shear connectors 44*c*. Further, the row of shear connectors 44*c* may be spaced from wall 64 of form 60 be the same distance W. Accordingly, each shear connector will have about the same load placed thereon.

Reference will now be made to FIGS. 4-10 which exemplify a method of construction, which may be utilized to prepare panel 10.

Referring to FIG. 4, a form 60 is provided. Form 60 is preferably sized so as to permit the production of a single panel 10. However, it will be appreciated that form 60 may be sized to permit the production of a plurality of panels 10 at the same time. The form may be of any construction known in the art, which is suitable to have concrete poured therein and removed therefrom when secured. Preferably form 60 is made from wood. For example, referring to FIG. 4, form 60 may comprise first and second opposed wood panels 62, which have a length corresponding to the desired vertical height of panel 10 as shown in FIG. 1 and first and second opposed second panels 64, which correspond to the width of panel 10 as shown in FIG. 1. The sides 62, 64 may be nailed together or otherwise secured together as is known in the art.

Preferably, shear connectors 44 are secured in position prior to concrete being poured into form 60. Accordingly, for example, rebar 52 may be provided in the bottom of form 60. Rebar 52 may extend to sides 62, 64 such that rebar 52 is visible when panel 10 is removed from form 60 (see FIG. 1 for example). Alternately, rebar 52 may terminate inwards of sides 62, 64 such that the outer edges of outer panel 12 are continuous and rebar 52 is not visible when panel 10 is removed from form 60. Preferably rebar 52 is positioned above bottom 66 of form 60 (see for example FIG. 5). Accordingly, when concrete is poured into form 60 to produce outer concrete panel 12, concrete will be located above and below rebar 52 as shown in FIG. 6. Accordingly, outer surface 14 of outer panel 12 will be continuous (i.e. rebar 52 is not visible). Rebar 52 is positioned such that first portion 46 of sheet connector 44 is located in the concrete. Sheer connectors 44 may be secured to rebar 52 by any means known in the art. For example, shear connectors 44 may be secured to rebar 52 by welding, mechanical fasteners such as tie or other means 68 known in the building arts.

Once rebar 52 and shear connectors 44 are positioned in the bottom of form 60, concrete may then be poured into form 60 so as to produce outer layer 12. The concrete may be tamped or otherwise compacted to reduce and preferably prevent the formation of voids or pockets in the concrete and to ensure that the concrete completely fills the bottom of form 60.

It will be appreciated that, in an alternate embodiment, rebar 52 may not be utilized. For example, the concrete may first be poured into form 60 and the shear connectors 44, and preferably the shear connectors tied to rebar 52, then positioned in the concrete. Alternately, shear connectors 44 could otherwise be secured in position in form 60, such as being secured to form 60 itself. It will be appreciated that shear connectors 44 and rebar 52 may each be utilized but that shear connectors 44 need not be secured to rebar 52.

Subsequently, preferably after the concrete of outer panel 12 has at least partially cured (e.g. has a rigid outer surface), intermediate drainage panel 36 may then be positioned on top of inner surface 16 of outer panel 12 (see for example FIG. 7).

In accordance with a preferred embodiment of this invention, the shear connectors 44 are preferably arranged so as to allow panels 30 and 36 to be inserted between a series of spaced apart shear connectors 44 and a section of a wall form or between two series of spaced apart shear connectors. Accordingly, for example, panels 36 and 30 may have a width that is equivalent to the distance between spaced apart shear connectors 44*a*′ and 44*a*″. Thus, one panel may be positioned between the columns of shear connectors defined by shear connectors 44*a*′ and 44*a*″ and a second panel may be positioned between the columns of shear connectors defined by shear connectors 44*a*″ and 44*a*‴. Accordingly, the intermediate portion 48 of shear connectors 44 may be positioned at the adjoining facing edges of adjacent panels 30 and at the adjoining facing edges of adjacent panels 36.

In accordance with such a preferred embodiment, intermediate drainage panel 36 is sized so as to have width corresponding to the distance between adjacent columns of re-bar. Accordingly, in the embodiment of FIG. 4, four intermediate drainage panels 36 may be positioned side by side along the width 64 of form 60. For example, a first intermediate drainage panel 36 maybe positioned between rebar 52*c* to which shear connector 44*a*′ is attached and rebar 52*d* to which shear connector 44*a*″ is attached. Accordingly, a first end of intermediate drainage panel 36 that is parallel to side 62 of form 60 may be slid under second portion 50 of the shear connectors 44 attached to rebar 52*d* and then lowered to be adjacent inner surface 16 of panel 12. The opposed side of intermediate drainage panel 36 adjacent rebar 52*b* may then be lowered by rotating it downwardly so as to seat flush on inner surface 16 of panel 12. Similarly, the first end of another intermediate drainage panel 36 may then be slid under second portion 50 of the shear connectors 44 attached to rebar 52*c* and then lowered to be adjacent inner surface 16 of panel 12. The opposed side of intermediate drainage panel 36 adjacent side 62 may then be lowered by rotating it downwardly so as to seat flush on inner surface 16 of panel 12. The remaining sections of form 60 may then be similarly provided with sections of intermediate drainage panel 36. In this way, shear connectors 44 need not extend through each intermediate drainage panel 36. Instead, sections of intermediate drainage panel 36 may be installed on outer surface 16 of panel 12 such that the joint between adjacent intermediate drainage panels 36 is positioned such that intermediate portion 48 of shear connectors 44 extends therethrough. The joint between adjacent panels 36 may then be sealed, such as by tape, an adhesive, caulking or the like.

It will be appreciated that, in an alternate embodiment, panel 36 may have an extent (e.g., a length extending in the direction of side 62) such that a hole or holes must be provided therein for sliding downwardly over shear connectors 44. For example, if an intermediate drainage panel 36 is of the same size as form 60, openings could be provided in intermediate drainage panel 36 for allowing the panel to be placed vertically downwardly on top of panel 12 with shear connectors 44 passing therethrough. Subsequently, the openings, which are provided for shear connectors 44, may be sealed, such as by an insulating filler material such as foam.

In accordance with an embodiment of this invention, it will be appreciated that the drainage channels are provided on the upper surface of drainage panel 36 when panel 36 is positioned in form 60.

Figure 8:
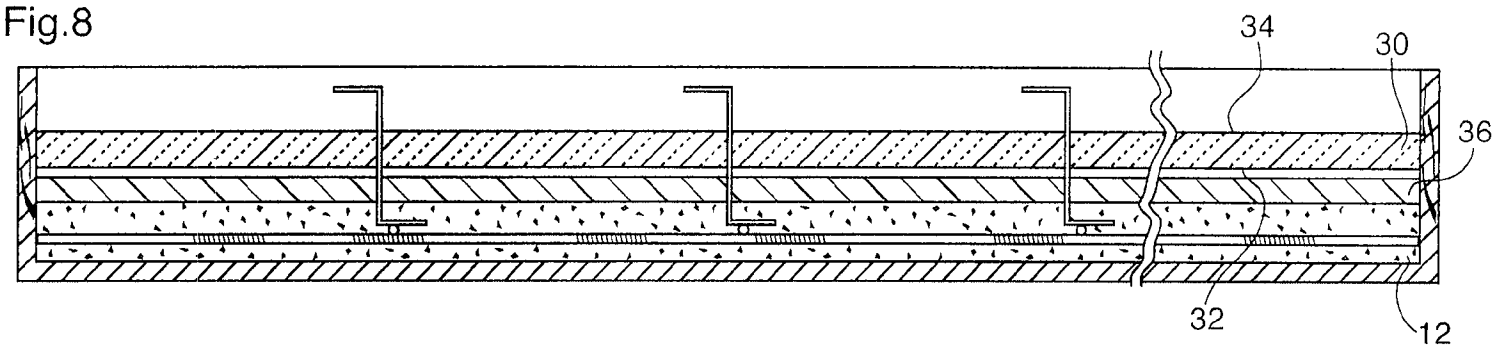
FIG. 8 is a cross-section along the line 5-5 in FIG. 4 wherein a plurality of insulation layers have been positioned in the form on top of the intermediate drainage panel.

Subsequently, as exemplified in FIG. 8, one or more insulation panels 30 may be positioned on top of drainage panels 36. Insulation panel 30 may be positioned in form 60 in any manner discussed with respect to intermediate drainage panel 36.

Subsequently, as exemplified in FIG. 9, vapour barrier 24 may be provided on top of insulation panel 30. Vapour barrier 24 may have an extent similar to the extent of form 60. Accordingly, a plurality of openings may be provided in vapour barrier 24 to allow vapour barrier 24 to be installed on top of insulation panel 30. The openings in the vapour barrier through which shear connectors 24 pass may then be sealed by any means known in the building arts to join together the edges of vapour barrier membranes, such as tape, caulking, placing portions of the barrier material over the joints and securing them in position by tape or an adhesive, or the like. Alternately, a plurality of strips of vapour barrier may be provided on top of panel 30 and then sealed together, such as by tape. Such strips may have a width equal to the spacing between adjacent rebar pairs (e.g., rebar pair 52*a* and 52*b* and rebar pair 52*b* and 52*c*) so that the strips are positioned such that intermediate portions 48 of shear connectors 44 are positioned between abutting edges of such strips.

As exemplified in FIG. 10, concrete may then be poured on top of vapour barrier 24 to complete the formation of the panel 10. The concrete may be poured so as to completely fill form 60 or to provide a desired thickness of concrete for concrete panel 10. Preferably, the concrete has a thickness such that second portion 50 of shear connector 44 is positioned internally in concrete panel 18.

In a preferred embodiment, rebar is also provided in concrete panel 18. Preferably, the rebar associated with shear connectors 44 so as to secure shear connectors 44 in position while concrete is poured into form 60 to form concrete layer 18. For example, after vapour barrier 24 has been positioned in form 60, rebar may be secured to, e.g., second portions 50 of shear connectors 44. Any attachment means known in the art may be used. Accordingly, second portions 50 of shear connectors 44 are secured in position and will remain in position as the concrete is poured into position and, preferably, tamped or otherwise compacted to reduce and preferably prevent the formation of voids in concrete panel 18.

Once the concrete of concrete panel 18 has cured to a sufficient degree, form 60 may be removed and the resultant panel 10 may then be stored for later use, shipped for use at a building site or used at the building site at which panel 10 is fabricated.

It will be appreciated that panel 10 may be constructed by pouring the inner concrete panel 18 in the bottom of the form 60. The subsequent construction steps would be in the reverse order of those set out in the description of FIGS. 5-10.

Although the invention has been described in conjunction with specific embodiment thereof, it is evident that many alternatives, modifications and variations will be apparent to those skilled in the art. Accordingly, it is intended to embrace all such alternatives, modifications and variations that fall within the spirit of the following claims.

The citation or identification of any reference in this application shall not be construed as an admission that such reference is available as prior art to the present invention.

The invention claimed is:

1. A prefabricated rain screen assembly comprising:

a) inner and outer concrete panels of corresponding size;

b) an intermediate drainage panel positioned adjacent the outer concrete panel, said drainage panel having an inner face and an outer face and a plurality of drainage channels provided on one of the inner and outer faces thereof, the outer face being adjacent an inner face of the outer panel;

c) an intermediate insulation panel positioned adjacent the intermediate drainage panel;

d) a vapour barrier positioned between the intermediate insulation panel and the inner concrete panel;

e) the intermediate drainage panel, intermediate insulation barrier and vapour barrier being sized to be one of (a) the same size as; and (b) smaller than said outer concrete panel; and f) a plurality of shear connectors, each having a first portion, a second portion and an intermediate portion extending between the first and second portions, the first portion being secured to the inner concrete panel and the second portion being secured to the outer concrete panel; and the inner concrete panel, the vapour barrier, the intermediate insulation panel, the intermediate drainage panel and the outer concrete panel being secured together to form a pre-fabricated assembly that is movable for installation.

2. The prefabricated rain screen assembly of claim 1 wherein the drainage channels are provided on the inner face of the intermediate drainage panel.

3. The prefabricated rain screen assembly of claim 1 wherein the inner face of the intermediate drainage panel is adjacent an outer face of the intermediate insulation panel.

4. The prefabricated rain screen assembly of claim 1 wherein the vapour barrier is positioned between an inner face of the intermediate insulation panel and an outer face of the inner concrete panel.

5. The prefabricated rain screen assembly of claim 1 wherein the first and second portions define bent feet embedded in the inner and outer concrete panels respectively.

6. The prefabricated rain screen assembly of claim 1 wherein the intermediate portion extends at an angle to each of the first and second portions.

7. The prefabricated rain screen assembly of claim 1 wherein the intermediate drainage panel comprises insulation material.

8. The prefabricated rain screen assembly of claim 1 further comprising rebar provided in each of the inner and outer concrete panels and the first portions of the shear connectors are secured to the rebar in the inner concrete panel and the second portions of the shear connectors are secured to the rebar in the outer concrete panel.

9. The prefabricated rain screen assembly of claim 1 wherein the intermediate insulation panel has an absence of internal channels.

10. The prefabricated assembly of claim 1 wherein said outer face of said first intermediate panel is substantially planar and defines a flat surface against which to cast said outer concrete panel.

11. The prefabricated assembly of claim 10 wherein said inner face of said second intermediate panel is substantially planar and defines a flat surface for contacting wet concrete of said inner concrete panel during fabrication.

12. The prefabricated assembly of claim 1 wherein said inner face of said second intermediate panel is substantially planar and defines a flat surface for contacting wet concrete of said inner concrete panel during fabrication.

13. The prefabricated assembly of claim 1 wherein said inner face of said first intermediate panel and said outer face of said second intermediate panel meet at a common interface, and said drainage channels are located at said common interface.

14. A prefabricated assembly comprising:

a) inner and outer concrete panels;

b) first and second intermediate panels positioned between the inner and outer concrete panels, each of the intermediate panels having an inner face and an outer face, one of the first and second intermediate panels having a plurality of drainage channels provided on one of the inner and outer faces thereof;

c) a vapour barrier positioned between the inner and outer concrete panels; and, d) a plurality of shear connectors, each having a first portion, a second portion and an intermediate portion extending between the first and second portions, the first portion being secured to the inner concrete panel and the second portion being secured to the second concrete panel;

the inner concrete panel, vapour barrier, first and second intermediate panels and outer concrete panel being secured together to form said prefabricated assembly.

15. The prefabricated assembly of claim 14 wherein the drainage channels are provided on the inner face of the first intermediate panel.

16. The prefabricated assembly of claim 14 wherein the inner face of the first intermediate panel is adjacent an outer face of the second intermediate panel.

17. The prefabricated assembly of claim 14 wherein the vapour barrier is positioned between an inner face of the second intermediate panel and an outer face of the inner concrete panel.

18. The prefabricated assembly of claim 14 wherein the first and second portions of the shear connectors define respective bent feet embedded in the concrete panels.

19. The prefabricated assembly of claim 14 wherein the intermediate portion extends at an angle to each of the first and second portions.

20. The prefabricated assembly of claim 14 further comprising rebar provided in each of the inner and outer concrete panels and the first portions are secured to the rebar in the inner concrete panel and the second portions are secured to the rebar in the outer concrete panel.

21. The prefabricated assembly of claim 14 wherein the second intermediate panel is an insulation panel, and said insulation panel has an absence of internal channels.

22. The prefabricated assembly of claim 14 wherein the drainage channels are provided on the inner face of the first intermediate panel; and the inner face of the first intermediate panel is adjacent an outer face of the second intermediate panel.

23. The prefabricated assembly of claim 22 wherein the outer face of the first intermediate panel is next to the outer concrete panel.

24. The prefabricated assembly of claim 22 wherein the vapour barrier is positioned between an inner face of the second intermediate panel and an outer face of the inner concrete panel.

25. The prefabricated assembly of claim 14 wherein the drainage channels are provided on the inner face of the first intermediate panel, and the outer face of the first intermediate panel is next to the outer concrete panel.

26. The prefabricated assembly of claim 14 wherein said outer face of said first intermediate panel is substantially planar and defines a flat surface against which to cast said outer concrete panel.

27. The prefabricated assembly of claim 14 wherein said inner face of said second intermediate panel is substantially planar and defines a flat surface for contacting wet concrete of said inner concrete panel during fabrication.

28. The prefabricated assembly of claim 26 wherein said inner face of said second intermediate panel is substantially planar and defines a flat surface for contacting wet concrete of said inner concrete panel during fabrication.

29. The prefabricated assembly of claim 14 wherein said inner face of said first intermediate panel and said outer face of said second intermediate panel meet at a common interface, and said drainage channels are located at said common interface.

30. A method of preparing a prefabricated panel comprising:

a) providing a first concrete panel having first portions of shear connectors provided therein, the shear connectors having intermediate portions extending outwardly from the first concrete panel;

b) positioning a vapour barrier in overlying relation to the first concrete panel, the intermediate portions extending through the vapour barrier;

c) positioning an insulation panel in overlying relation to the vapour barrier, the intermediate portions of the respective shear connectors extending through the insulation panel;

d) positioning a drainage panel in overlying relation to the insulation panel, the drainage panel having drainage paths defined therein, the intermediate portions of the respective shear connectors extending outwardly of the drainage panel; and, e) forming a second concrete panel in overlying relation to the drainage panel, the intermediate portions of said shear connectors extending to the outer panel, wherein second portions of shear connectors are embedded in the second concrete panel; and wherein steps (a)-(e) are conducted sequentially in the order of step (a) to step (e) or step (e) to step (a); and the first concrete panel, vapour barrier, insulation panel, drainage panel and second concrete panel fit within a common form and are secured together to define a movable pre-fabricated panel.

31. The method of claim 30 wherein step (a) further comprises positioning rebar in a form prior to pouring concrete into the form to produce the first concrete panel and step (e) further comprises positioning additional rebar so as to be in the second concrete panel once the second concrete panel is formed.

32. The method of claim 31 wherein step (a) further comprises securing the first portions to the rebar in the first concrete panel and step (e) further comprises securing the second portions to the rebar in the rebar in the second concrete panel.

33. The method of claim 30 further comprising shipping the prefabricated panel to a construction site.

* * * * *